United States Patent [19]

Herrick

[11] 4,012,732

[45] Mar. 15, 1977

[54] SECURITY DEVICE

[76] Inventor: Kennan C. Herrick, 2160 Mastlands Drive, Oakland, Calif. 94611

[22] Filed: Mar. 19, 1976

[21] Appl. No.: 668,604

[52] U.S. Cl. ..... 340/279; 340/276; 340/280; 340/309.1

[51] Int. Cl.[2] ..... G08B 21/00; G08B 13/00

[58] Field of Search ..... 340/279, 280, 421, 309.1

[56] References Cited

UNITED STATES PATENTS

| | | | |
|---|---|---|---|
| 2,847,656 | 8/1958 | Ricks | 340/280 |
| 3,803,579 | 4/1974 | Compton | 340/279 |
| 3,911,425 | 10/1975 | Muncheryan | 340/279 |
| 3,913,092 | 10/1975 | Klingenberg | 340/279 |
| 3,929,335 | 12/1975 | Malick | 340/279 |

*Primary Examiner*—Glen R. Swann, III

*Attorney, Agent, or Firm*—Warren, Chickering & Grunewald

[57] ABSTRACT

A security device includes an alarm that is actuated after a predetermined period of no human physical activity, which device includes a clock set to actuate the alarm after a predetermined period of inactivity, an activity sensor that resets the clock when human activity is sensed, and a means to sense an inanimate object, such as a set of keys, and which, when the inanimate object is absent, will not actuate the alarm when the predetermined time period has passed. There is also disclosed means to actuate the alarm when any activity is sensed if the inanimate object is absent.

8 Claims, 1 Drawing Figure

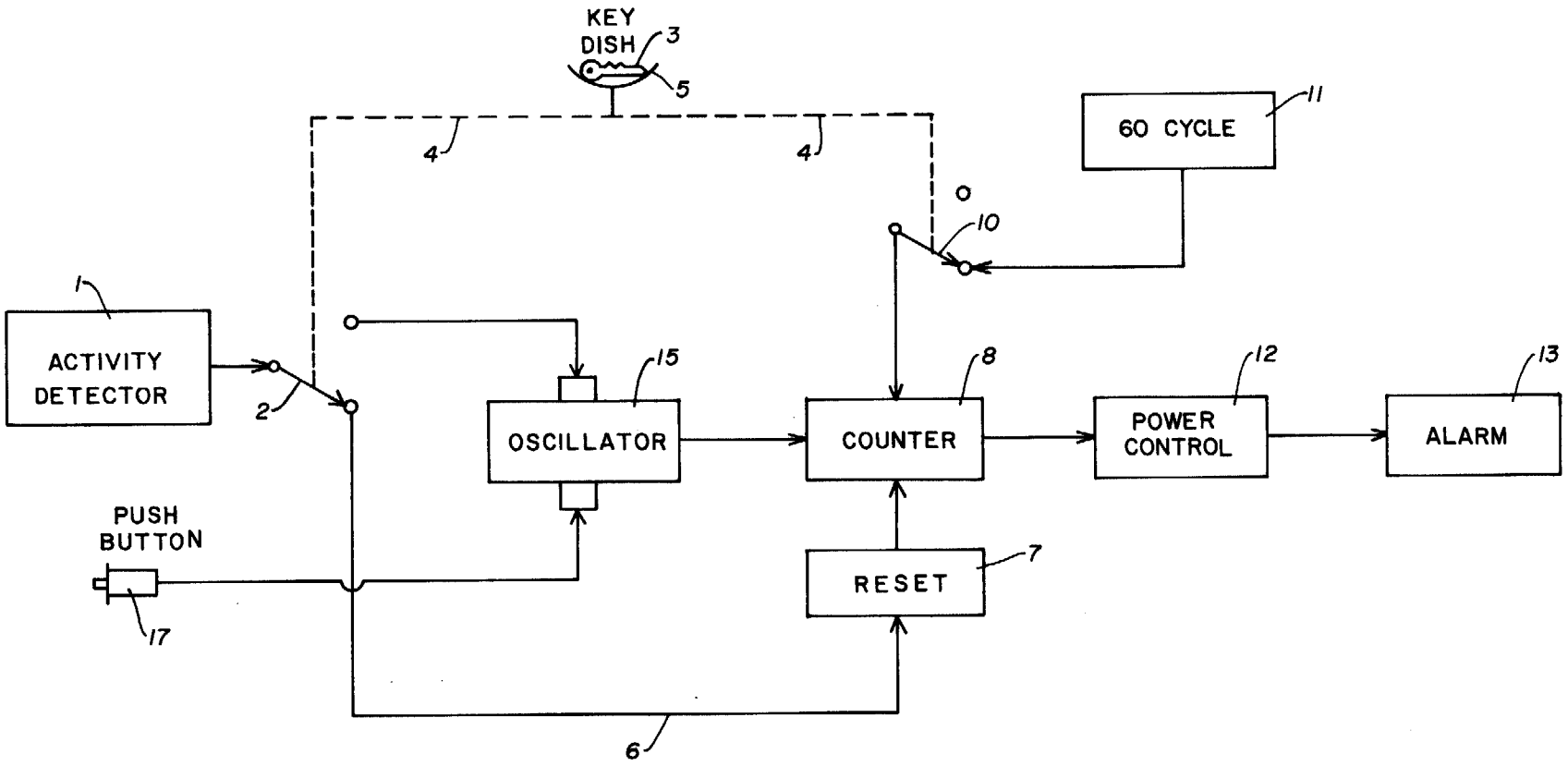
ALARM
13
POWER CONTROL
12
60 CYCLE
11
10
0
COUNTER
8
RESET
7
4
4
KEY DISH
3
5
OSCILLATOR
15
6
2
ACTIVITY DETECTOR
1
PUSH BUTTON
17

SECURITY DEVICE

BACKGROUND OF THE INVENTION

Frequently people who are old or ill live alone. When such a person is suddenly striken with an affliction that prevents him from summoning help, he can die, whereas reasonably prompt help could save him. Such afflictions as a stroke, a fall which causes a broken pelvis, or a diabetic coma which are not fatal in themselves become fatal because days or even weeks may pass before the affliction is discovered.

This problem has been dealt with in the past with devices which sense human physical activity and sound an alarm if such physical activity is not sensed for a long time period. Many of these devices must be worn, for example, on the wrist of the user, and forgetting to put such devices on before going to bed or after bathing will cause the alarm to ring when no problem exists. Other devices must be unplugged if the occupant of the premises is to be away on a visit for a long period of time. Everyone, and particularly older persons, are likely to forget to wear an alarm or to unplug it before leaving with the result that disturbing false alarms are sounded.

THE INVENTION

This invention is a security device that overcomes or greatly mitigates the above-noted problems. The security device of this invention includes an alarm that is adapted to signal for help when it is actuated. The device also includes a clock which measures one or more pre-selected time periods and is adapted to actuate the alarm when a pre-selected time period has elapsed. The device also includes a human physical activity sensor that is capable of sensing human physical activity and acting in response to that activity to reset the clock to the beginning of the predetermined time period. The device also includes a means for sensing an inanimate object that is in contact with that sensing means and is adapted to act in response to the absence of the inanimate object to prevent actuation of the alarm when the predetermined time period has elapsed. The device of this invention preferably includes means which act in response to the absence of the inanimate object to cause the alarm to be actuated when the human activity sensor senses human activity.

The alarm associated with the device of this invention may be any of those known to the art. Depending upon the circumstances under which the security device is to be used, the alarm may be an audible alarm, such as a bell, or it might be a visible alarm, such as a blinking light or a wigwag signal, or it may be a more sophisticated alarm, such as sending a telephone message. The preferred alarm is a combination of an audible alarm in conjunction with a window-mounted, illuminated wigwag signal which could summon help at night or during the day and which would be readily identified as an alarm.

The clock employed in the device of this invention is any device capable of accurately measuring a predetermined time period and actuating an alarm in response to the passage of that time. The term clock is used in a generic sense to include any device or combination of devices that will perform the above function. The clock employed in the device of this invention must also be capable of being reset to zero, that is, to be reset to start the predetermined time interval in response to a signal from the human activity sensor. The clock preferably is an electronic counter that may be set to count electric pulses and to actuate the alarm after a predetermined number of such electric pulses has been counted. For example, a counter connected to line voltage frequency will count 3,600 pulses per minute and may be set to actuate the alarm after some predetermined number of pulses has been counted. As will be described in more detail hereinafter, such a counter is useful for adding the function of a burglar alarm to the device of this invention when the occupant of the residence is absent.

The human activity sensor employed in the device of this invention may be any of those known to the art. The sensor must be one that automatically senses activity and does not require the deliberate actuation by a human being. Suitable activity sensors are those used with other alarm systems, such as an electric switch mat that is commonly used under a carpet in burglar alarm systems. Other devices such as photoelectric cells may be employed to sense human activity. The human activity sensor should be placed in a high traffic area of the residence so that the clock will frequently be reset to zero from normal human circulation within the residence. For example, the human activity sensor desirably would be in a hall that must be traversed to go between the various rooms of the residence. The activity sensor is adapted by known means to reset the clock to zero each time human activity is sensed.

Another sensor essential to the device of this invention is one which senses the presence of an inanimate object. The preferred inanimate object sensor is a dish or a hook or a like structure which is integral with the rest of the security device of this invention. The dish or hook or like structure is one in which the resident will normally keep his house and/or automobile keys. The sensor could be adapted to sense other inanimate objects, but it is preferred that it sense keys in that when one leaves his residence, he always takes his keys with him, and the very act of taking his keys with him will prevent the alarm from being actuated with the predetermined time period has elapsed. The sensor is adapted to sense the presence of the inanimate object, and the presence of the inanimate object is required for the intended operation of the security device. Specifically, if the inanimate object is absent from its sensor, some necessary aspect of the security device is inactivated so that the passing of the predetermined time period will not actuate the alarm. The inanimate object may be sensed by any of the methods known to the art. For example, the weight of the inanimate object when it is on its sensing device could cause a switch to open. It is preferred, for reasons of reliability, to employ more sophisticated metal sensors that operate by induction or capacitance to keep all circuits intact when the inanimate object is in contact with the sensor. Typically, the resident will always keep his keys in a dish provided with the device. While the keys are in the dish, the device is operative to actuate the alarm after a predetermined period of inactivity has elapsed, but when the keys are removed from the dish, their absence is sensed, and in response to the absence, an interruption in the alarm system is effected so that the lapse of the predetermined time period without human activity will not actuate the alarm.

In a preferred embodiment of the invention, the absence of the inanimate object will cause sensing of human activity to actuate the alarm rather than to reset the clock. Thus, if a resident takes his keys with him when he leaves his residence, the removal of the keys causes two functions to be effected. The first function is that the passing of the predetermined time period without human activity will not cause the alarm to be actuated. The second function is that the means for sensing human activity will cause the alarm to be actuated when human activity is sensed.

BRIEF DESCRIPTION OF THE DRAWING

The invention may be better described with reference to the accompany drawing which is a schematic representation of one device embodying this invention. The drawing is provided to be illustrative rather than limiting on the scope of the invention.

DETAILED DESCRIPTION OF THE INVENTION

The device of this invention as illustrated in the drawing includes an activity detector 1 which is connected through a switch 2. In the embodiment illustrated an inanimate object, in this case a key 3, is in the inanimate object detector 5, and in response to sensing the inanimate object, the switch 2 is in the position illustrated wherein the activity detector is connected through line 6 to reset 7 which resets counter 8 whenever human activity is detected at activity detector 1. The broken line 4 is representative of physical or electrical means for operating switch 2 and switch 10 which will be described in more detail hereinafter.

With key 3 in its detector 5, switch 10 is in the position shown wherein a source of 60 cycle frequency 11 is supplied through switch 10 to counter 8. Counter 8 is set so that when a predetermined number of pulses are counted, it acts in response to that number of impulses to actuate power control 12 which, in turn, actuates alarm 13.

In the embodiment illustrated, counter 8 continually counts 60 cycle pulses until the predetermined number has been reached at which time power control 12 actuates alarm 13. However, every time human activity is sensed at activity detector 1, reset 7 is actuated to reset the counter 8 back to zero so that it starts the predetermined time period from the beginning again. Accordingly, while the key 3 is in the detector 5, alarm 13 will not be actuated unless there is an absence of activity for the predetermined time period for which counter 8 is set.

When key 3 is removed from dish 5, the means 4 causes switch 2 and switch 10 to be repositioned. Repositioning switch 10 disconnects counter 8 from the 60 cycle source 11 so that it does not count. Changing switch 2 connects activity detector 1 with oscillator 15. Oscillator 15 provides electrical pulses at a substantially higher frequency than 60 cycles so that oscillator 15 can drive the counter 8 through its predetermined number of pulses very quickly. For example, if oscillator 15 provides pulses at 60,000 cycles per second, the counter 8 will cause the alarm to go off in 1/1,000th of the predetermined time period that would be set from the 60 cycle source 11. Thus, if the time period from 60 cycle source 11 were 8 hours between the last sensed activity in actuation of the alarm, when the key is out of the key dish, the activity sensor would actuate the oscillator and drive the counter through the entire cycle in less than a minute so that the alarm would go off. It is evident that, when the key is out of the key dish, human activity is sensed very quickly, and the sensed human activity causes an alarm to be actuated so that the device of this invention provides security against intruders when residents are absent, and it provides security against accidents or afflictions unknown to others when the resident is present.

The clock employed in the device of this invention may be preset for a specific time period: for example, nine hours. The clock may be constructed to include several alternative pre-set time periods: for example, two hours during the day and nine hours at night. The clock may also be constructed to be adjusted by the user for any desired pre-set time period. It is preferred that the clock have at least one pre-set time period, for example nine hours, which will actuate the alarm in the absence of human activity regardless of whether or not other alternative time periods are available.

Push button switch 17 is provided to actuate oscillator 15 to drive the counter through its predetermined number of pulses in a short time period. Push button 17 is used to check the operability of the circuit without waiting for the predetermined time period to pass. For example, when a device embodying this invention is first installed and preset to actuate the alarm in nine hours, it is unreasonable for the installer to wait for nine hours or to return in nine hours to be sure the device is operative.

By actuating switch 17, the oscillator 15 is actuated and quickly provides the number of pulses to counter 8 required to actuate the alarm 13. By timing the interval from pushing switch 17 until the alarm is actuated and knowing the frequency of the pulses from oscillator 15, the length of the preset time period can also be checked. Of course push button 17 can and should be used frequently to check whether the entire circuit is operative.

By locating one or more push buttons 17 at various positions in a residence, for example next to a bed, push button 17 may be used as an emergency alarm to summon help immediately, for example if a person is injured or falls ill or if a prowler enters a residence at night.

What is claimed is:

1. A security device comprising:

a. an alarm, b. a clock adapted to actuate said alarm when a predetermined time period has elapsed, c. a human physical activity sensor adapted to reset said clock to the beginning of said predetermined time period when human activity is sensed, and d. means for sensing an inanimate object in contact therewith, said means adapted in the absence of said inanimate object to prevent actuation of said alarm when said predetermined time period has elapsed.

2. The device of claim 1 wherein said means to sense an inanimate object is adapted, in the absence of said inanimate object, to cause said human physical activity sensor to activate said alarm when human physical activity is sensed.

3. The device of claim 1 wherein said clock comprises a source of power line frequency and a counter.

4. The device of claim 3, further comprising an oscillator of a frequency higher than said power line frequency wherein the absence of said inanimate object causes said high frequency oscillator to drive said counter when human physical activity is sensed.

5. The device of claim 4 further comprising a manual switch activate said high frequency oscillator.

6. The device of claim 1 wherein said inanimate object is a key.

7. The device of claim 1 wherein said inanimate object is metal, and said means for sensing an inanimate object is an induction-actuated circuit.

8. The device of claim 1 wherein said inanimate object is metal, and said means for sensing an inanimate object is a capacitance actuated circuit.

* * * * *